US005772207A

United States Patent [19]

Caseila

[11] Patent Number: 5,772,207

[45] Date of Patent: Jun. 30, 1998

[54] BOARD GAME

[76] Inventor: Stephen J. Caseila, 192 Herbert Ave., Closter, N.J. 07624

[21] Appl. No.: 827,515

[22] Filed: Mar. 29, 1997

[51] Int. Cl.[6] ..... A63F 3/02

[52] U.S. Cl. ..... 273/260

[58] Field of Search ..... 273/236, 241, 273/242, 260, 261, 290

[56] References Cited

U.S. PATENT DOCUMENTS

| | | | |
|---|---|---|---|
| 3,734,505 | 5/1973 | Germanis | 273/290 X |
| 3,806,125 | 4/1974 | Bialek | 273/290 X |
| 3,902,724 | 9/1975 | Hersey | 273/290 X |
| 3,905,601 | 9/1975 | Tindall | 273/290 X |
| 4,700,951 | 10/1987 | Lachenmeier et al. | 273/290 X |
| 4,776,597 | 10/1988 | Rudell | 273/290 X |
| 5,048,840 | 9/1991 | Johnson | 273/290 X |
| 5,209,486 | 5/1993 | Brotz | 273/290 X |
| 5,318,305 | 6/1994 | LoCoco | 273/290 X |
| 5,566,944 | 10/1996 | Anderson | 273/290 X |

*Primary Examiner*—William E. Stoll

[57] ABSTRACT

A board game consisting of square, flat-playing pieces designed for two, three of four players to be played on a standard chess or checkerboard. These pieces move about the board in a forward or sideways direction one square at a time. The primary purpose is to capture all the opponents' pieces by landing on the opponents' square and then stacking your piece or pieces atop that piece or pieces. A piece may only move backward once it has captured another piece or it has reached the opposite end of the board and is therefore crowned with one additional piece.

2 Claims, 16 Drawing Sheets

BOARD GAME

BACKGROUND OF THE INVENTION

1. Field of the Invention

This invention pertains to a two to four-person board game consisting of movable pieces, the object of which is to capture all of the opponents' pieces.

2. General Background

It is the objective of the present invention to provide a new type of board game that utilizes the standard checkerboard, but provides an alternative to chess or checkers which are board games that have been around for many centuries.

The game being described is like chess in it's warlike objective but completely different in its movements and strategies, providing for a quicker and simpler game and one that may be enjoyed by a wider audience.

Checkers is a game that is more broadly played but can have a tendency of being repetitive in its combinations. The present invention has some similarities to checkers in its simplicity of movement but is more varied in its combinations especially when the game is played with 3 to 4 players.

U.S. Pat. No. 5,318,305 to LoCoco describes a game of pieces that move on a modified checkerboard. There is a similarity of the LoCoco patent to the present invention in the stacking of pieces; however the method, manner and purpose of the stacking in each game are very different. In the LoCoco patent, pieces on the same team (color) stack upon a piece of the same team (color) in an effort to alter the number of spaces that the resulting stacked piece can move. The object of the pieces in the LoCoco patent is to reach specific marked safety zones. In the presently described invention, stacking is the result of capturing an opponent's piece of pieces. Other games, for instance checkers and U.S. Pat. No. 4,776,597 to Rudell and U.S. Pat. No. 5,048,840 to Johnson, all involve stacking of pieces but each varies in its movements, tactics and objectives.

The present game involves both chance and skill that makes the game playable by diverse players, for instance an adult and a child. Once the basic moves and tactics are mastered, whether it is a child or an adult, consistent winning by a single player becomes difficult making the game more challenging. In traditional two-person board games, a difference in age or of IQ will typically allow the one player a consistent win over the other, especially in chess. The players of the game do not rely on a wheel or die to determine their moves and therefore the game encourages abstract, strategic thought for current and future moves. One of the main tactics of the game is to flank an opponent's single piece which is not able to move backward and is therefore vulnerable to attack and capture.

Another intention of the game is to provide a board game that is economical and convenient. Since it may be played on an existing checkerboard, only the pieces will need to be purchased and the game will not require much space.

The present invention adds a new dimension to traditional two man board games by adding the third and fourth player, thus increasing the number of combinations.

SUMMARY OF THE PRESENT INVENTION

The preferred embodiment of the apparatus of this invention is a flat, square board having a grid of orthogonal lines thereon, identical to existing checkerboards. These lines define a series of adjacent rows and columns each of which consist of a plurality of individual spaces or squares, which alternate between dark and light squares or could be multiple contrasting colored or shaded squares. Each square should be at least approximately one and one-half inches square. Each player is provided with nine active playing pieces that are shaded or colored so as to distinguish those of one player from those of another player so that in a game of four players there would be four different shades or colors.

During play, the players take turns clockwise moving their pieces one space forward or one space to the left or to the right. If an opposing piece is placed one space before or one space to the side of an another player that player must, on his turn, capture this piece by stacking his piece or pieces upon the opposing player's piece or pieces. Once a piece is stacked it can not be unstacked. Once a single piece has captured another piece as just described, that piece is then able to move one square backward as well as one square forward or sideways. There is no limit as to how many pieces may be stacked upon another. A single piece may when it reaches the opposite side of the board be "crowned" whereby a single piece of the same color is stacked upon that piece, at which time the crowned piece may then move one square forward or sideways as well as backward. Neither a single nor a stacked piece can move onto a square already occupied by a piece of the same team (color). Pieces may never move more than a single square at a time nor may they ever move diagonally. A player may not return to the same square from which it just previously vacated on that player's last turn.

BRIEF DESCRIPTION OF THE DRAWINGS

To better understand the nature and objects of the present invention, reference should be made to the accompanying drawings in which like parts are given like reference numerals and, wherein:

FIG. 10 illustrates certain limitations of movement for these playing pieces;

FIG. 11 illustrates certain limitations of movement for these playing pieces;

DETAILED DESCRIPTION OF THE PREFERRED EMBODIMENT

Figure 1:
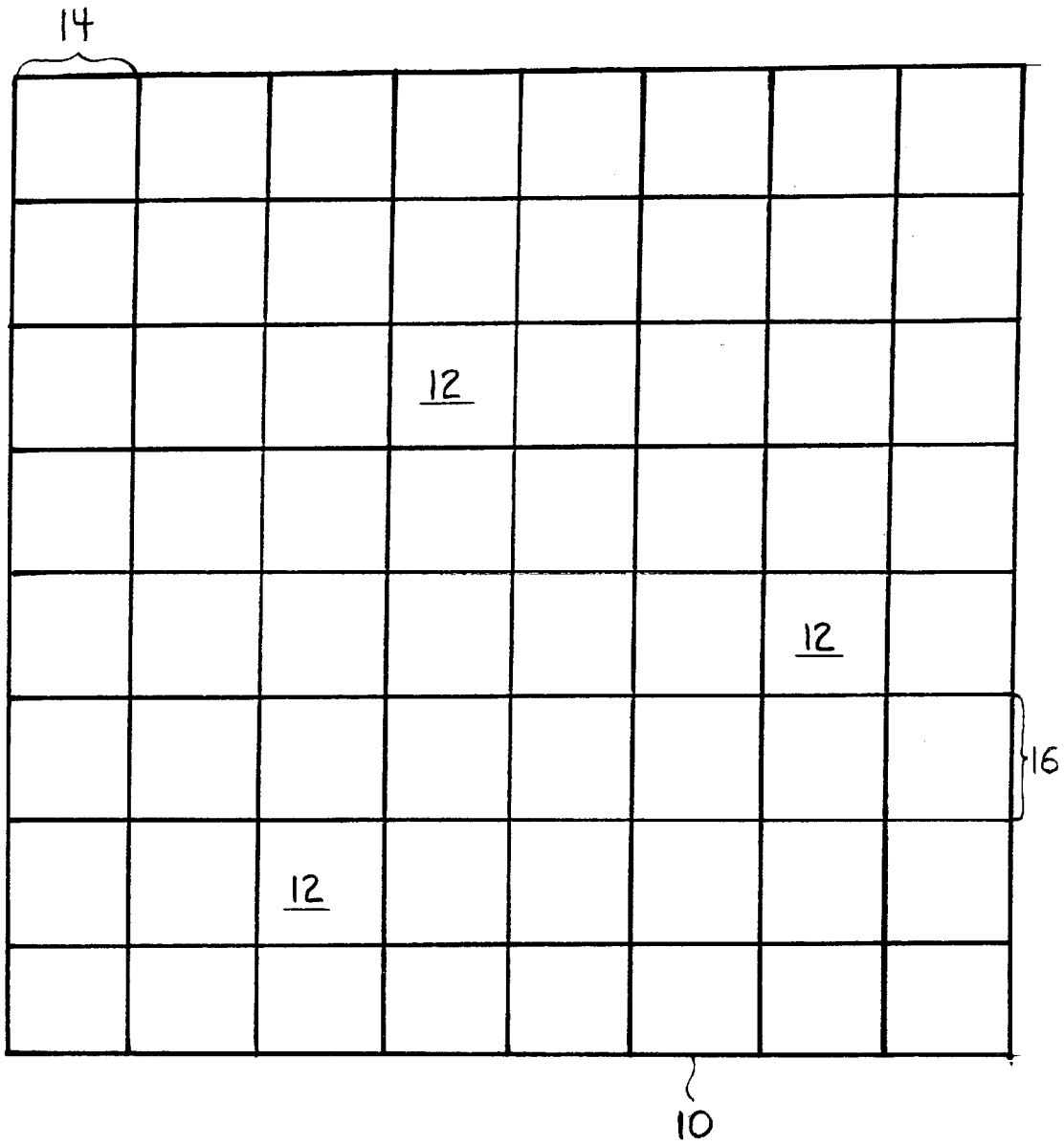
FIG. 1 is a plan view of the playing board of the invention.

Referring initially to FIG. 1, there is shown a square game board 10 that is divided into a series of equal spaces 12. In the preferred embodiment, board 10 is configured with eight columns 14 of eight spaces 12 each and eight rows 16 of eight spaces 12 each. The different squares or spaces must be of different contrasts or shades so as to distinguish one square from another.

Figure 2:
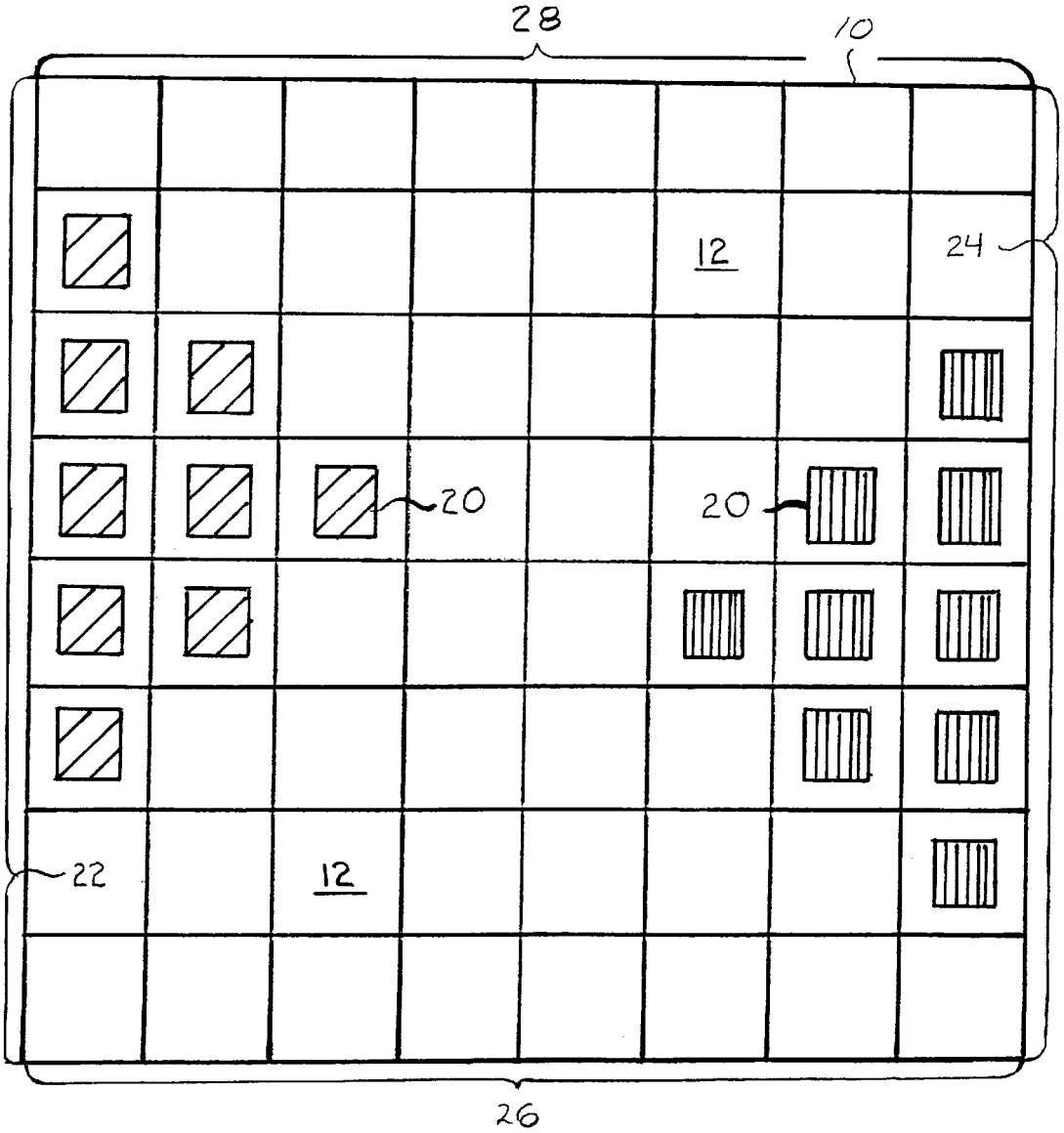
FIG. 2 is a plan view of the playing board of the invention with all the playing pieces properly located at the beginning of play when two opponents are playing.

FIG. 2 illustrates the location of playing pieces 20 in their respective home regions 22 and 24 upon board 10 at the beginning of play when only two players are playing. In this embodiment, each player is provided with nine playing pieces 20 which are colored or shaded so as to easily distinguish the playing pieces 20 of the first player from the playing pieces 20 of the second player. Each set of nine playing pieces 20 are identical in value and must be positioned at the beginning of the game on the squares 12 in their respective home regions 22 and 24 as depicted in FIG. 2. The two sets of nine playing pieces 20 differ from the other set only in color or shade.

While the players themselves can determine who is to move first, lacking such an agreement, the youngest player should make the first move. In subsequent games the players can if they desire alternate who makes the first move.

Player in home region 24 most move forward toward home region 22 or sideways toward home regions 28 and 26. Player initially setup in home region 22 must move forward toward home region 24 or sideways toward home regions 26 and 28.

Each player move as explained below, one move or space 12 per play, with play alternating between the players, in turn, until all pieces 20 of the opponent have been captured.

Figure 3:
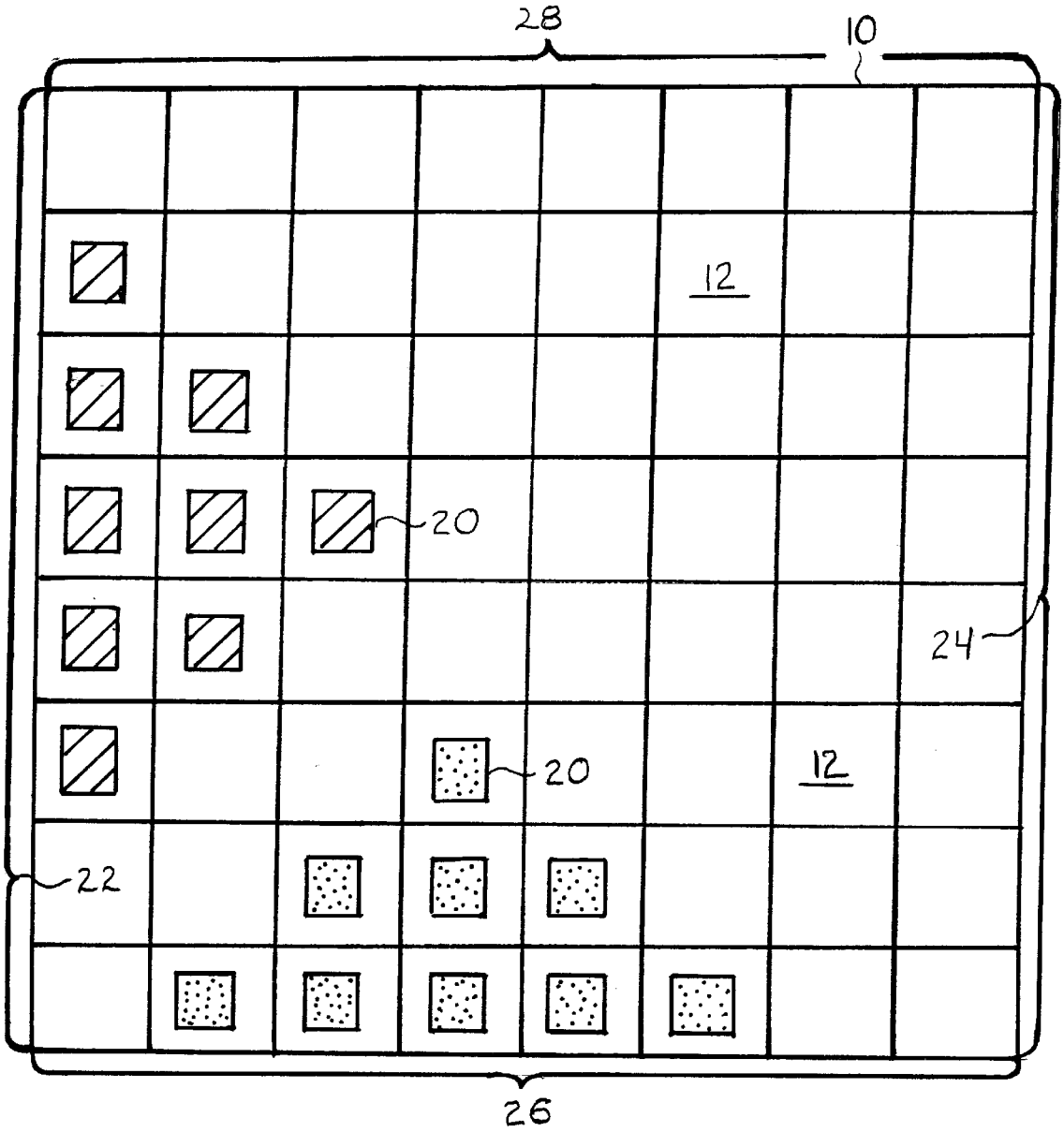
FIG. 3 is an alternate setup plan view of the playing board of the invention with all the playing pieces properly located at the beginning of play when two opponents are playing.

FIG. 3 illustrates an alternate initial setup of the playing pieces 20 at the start of the same upon board 10 when only two players are playing. One set of playing pieces 20 sets up his pieces in home region 26 rather than home region 24. Player in home region 26 most move forward toward home region 28 or sideways toward home regions 22 and 24 one square 12 per turn. Player initially setup in home region 22 must move forward toward home region 24 or sideways toward home regions 26 and 28 one square 12 per turn.

Figure 4:
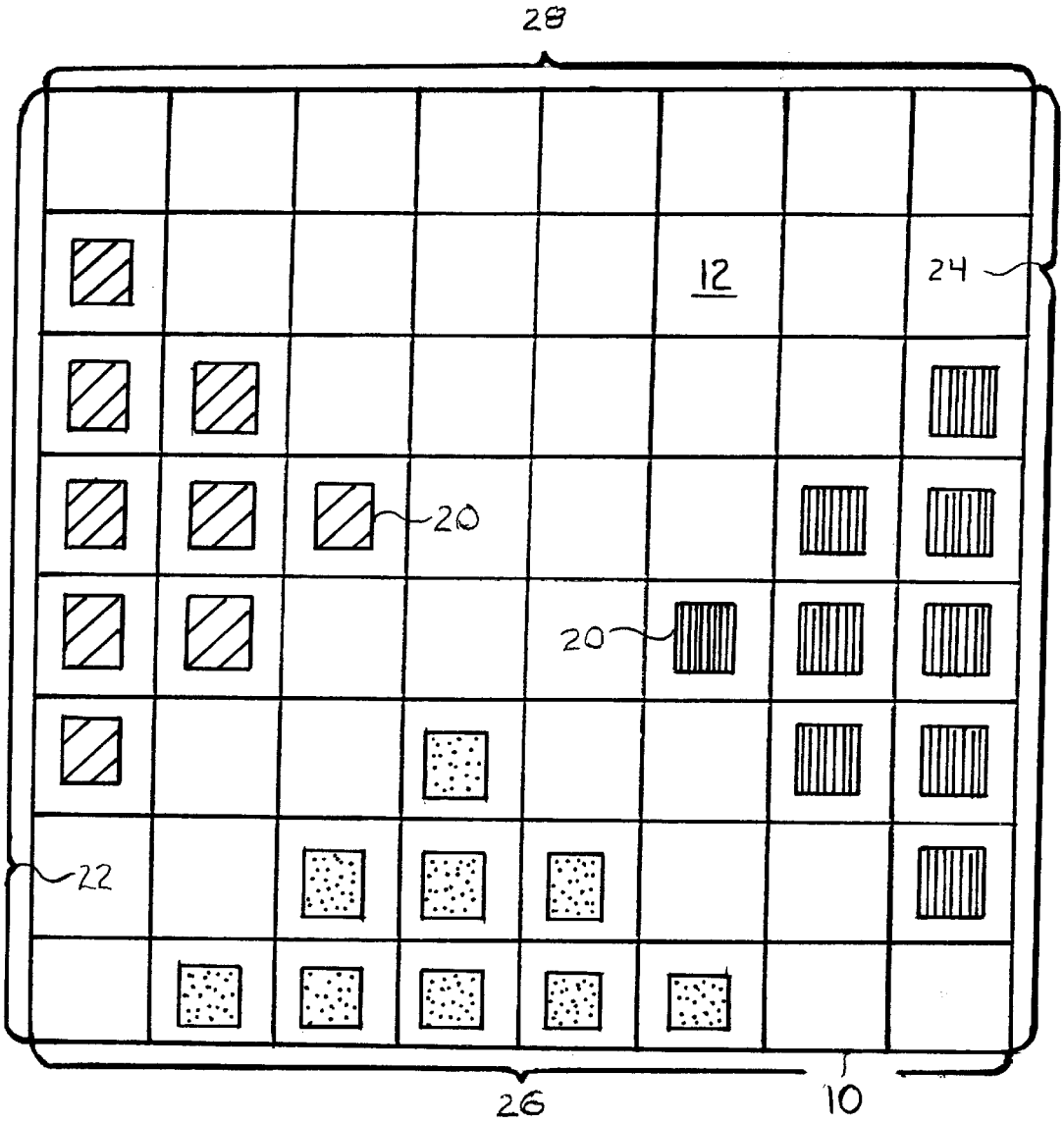
FIG. 4 is a plan view of the playing board of the invention with all the playing pieces properly located at the beginning of play when three opponents are playing.

FIG. 4 illustrates the initial setup of the playing pieces 20 at the start of the game upon board 10 when three players are playing. One set of playing pieces 20 is set up in home regions 22, 24 and 26 as depicted in FIG. 4. Player in home regions 26 must move forward and toward home region 28 or sideways toward home regions 22 and 24. Player initially setup in home region 22 must move forward toward home region 24 or sideways toward home regions 26 and 28. Player initially setup in home region 24 must move forward toward home region 22 or sideways toward home regions 26 and 28. Players move as described below one move or space 12 per turn. Players take turns clockwise.

Figure 5:
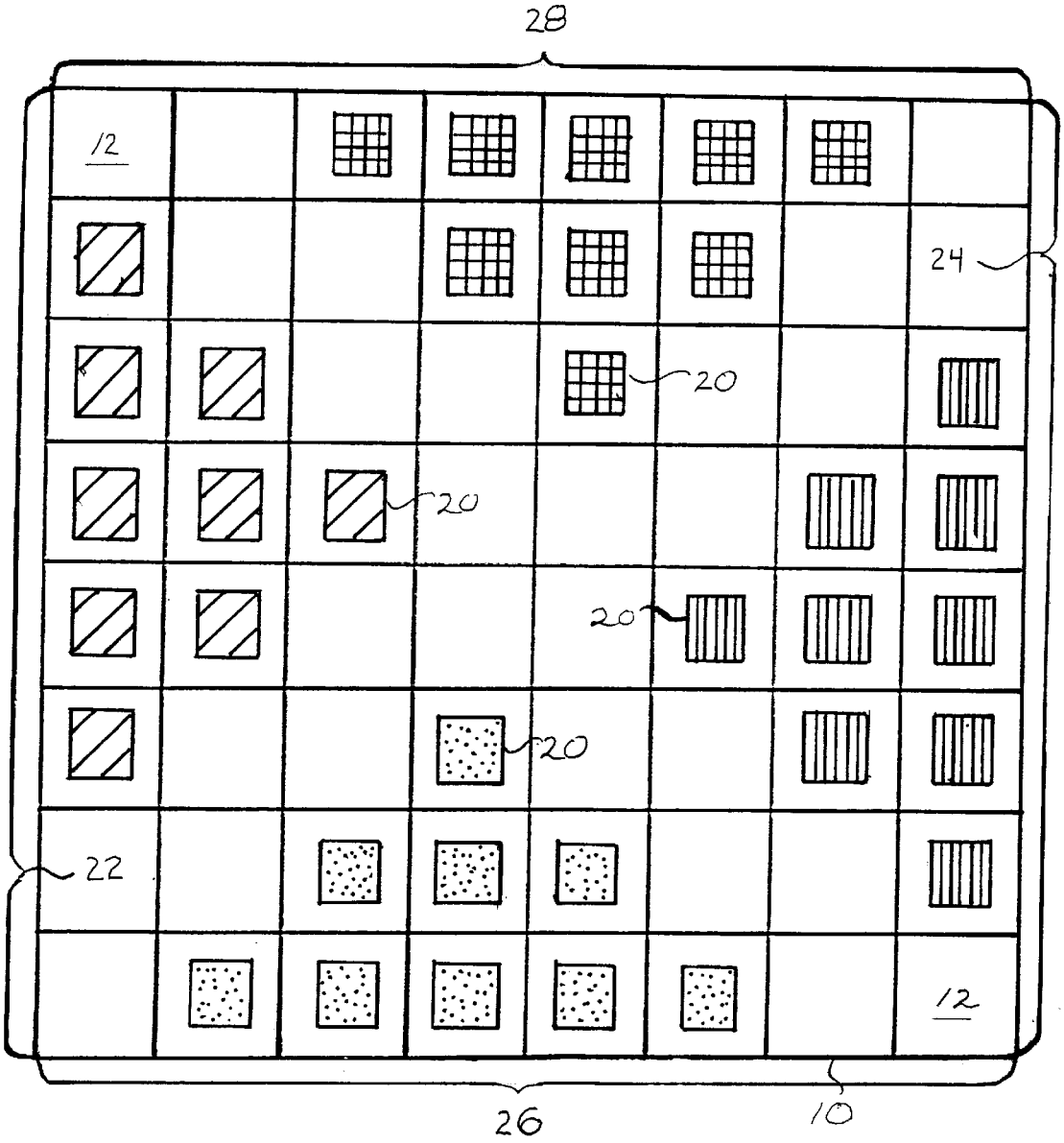
FIG. 5 is a plan view of the playing board of the invention with all the playing pieces properly located at the beginning of play when four opponents are playing.

FIG. 5 illustrates the initial setup of the playing pieces 20 at the start of the game upon board 10 when four players are playing. One set of playing pieces 20 is set up in home regions 22, 24, 26 and 28 as depicted in FIG. 5. Player in home region 26 must move forward toward home region 28 or sideways toward home regions 22 and 24. Player initially setup in home region 22 must move forward toward home region 24 or sideways toward home regions 26 and 28. Player initially setup in home region 24 must move forward toward home region 22 or sideways toward home regions 26 and 28. Player initially setup in home region 28 most move forward toward home region 26 or sideways toward home regions 22 and 24. Players move as described below one move or space 12 per turn. Players take turns clockwise.

Figure 6:
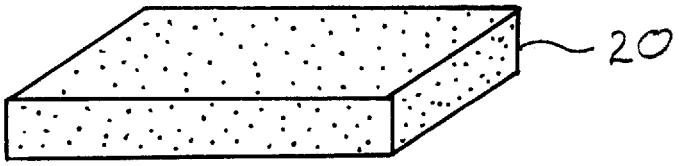
FIG. 6 is an illustration of a single playing piece.
Figure 10:
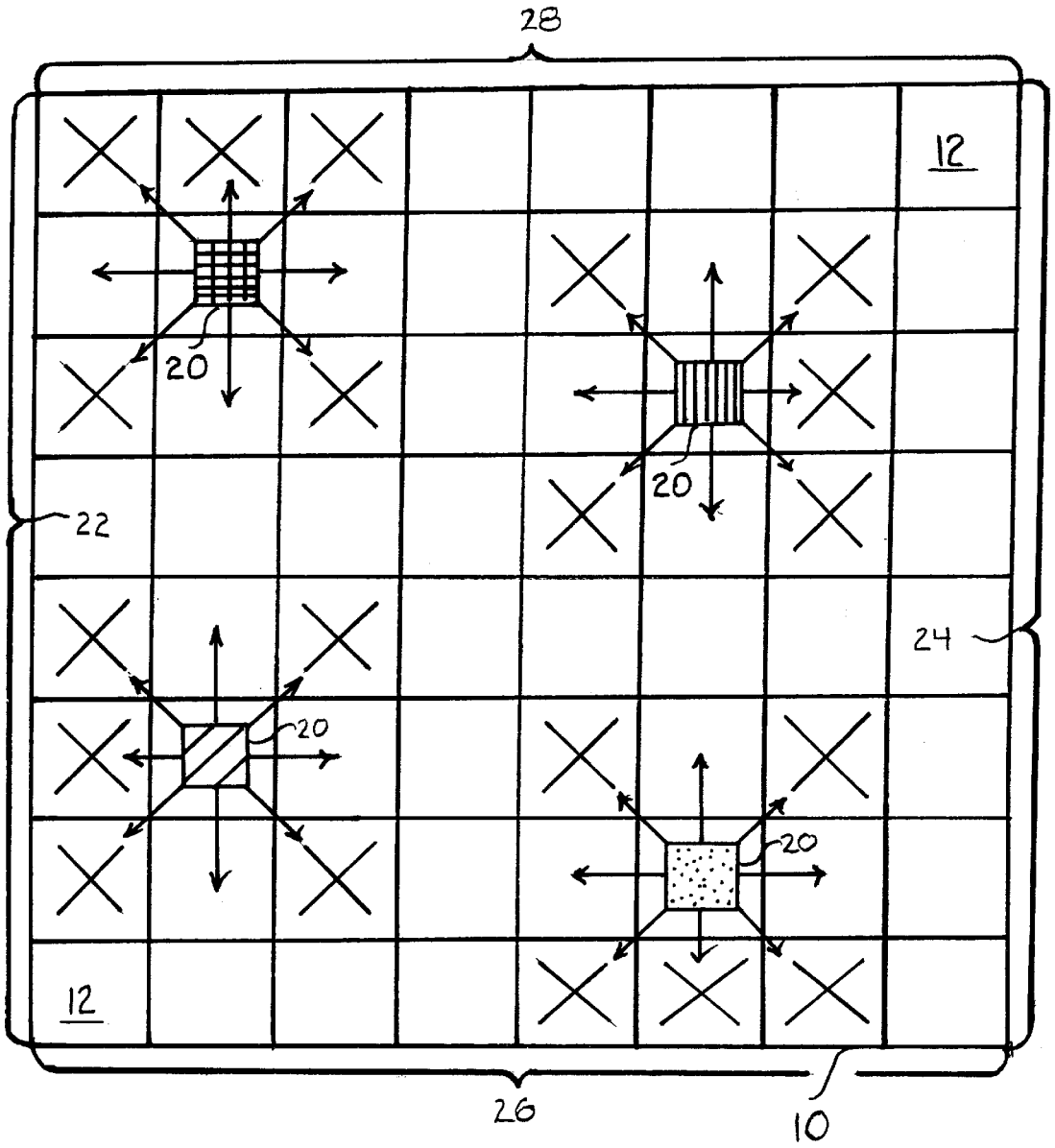
FIG. 10 is a plan view of selected single (non-stacked) playing pieces in which their direction and distance of movement is illustrated. Also

FIG. 10 illustrates the permissible and non-permissible moves of single (unstacked) playing pieces 20 as depicted in FIG. 6 on board 10. As shown single (unstacked) playing pieces 20 can move each turn only one square 12 forward or sideways. Forward or sideways is determined based on where the player's original home range was set up as described in FIG. 5. So, for instance, single (unstacked) piece 20 from home region 22 can only move one space 12 forward toward home region 24 and one space 12 sideways toward home regions 28 and 26. Single (unstacked) piece 20 from home region 24 can only move one space 12 forward toward home region 22 and one space 12 sideways toward home regions 28 and 26. Single (unstacked) piece 20 from home region 26 can only move one space 12 forward toward home region 28 and one space 12 sideways toward home regions 22 and 24. Single (unstacked) piece 20 from home region 28 can only move one space 12 forward toward home region 26 and one space 12 sideways toward home regions 22 and 24.

All pieces 20 can never move backward or diagonal. This illustration assumes four players are playing but the movements are the same regardless of whether it is two, three or four players playing.

Figure 7:
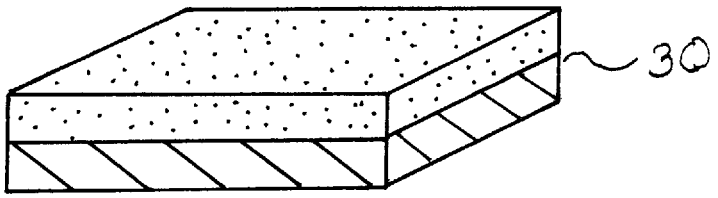
FIG. 7 is an illustration of a multiple playing piece resulting after a capture of an opponent's single piece.
Figure 8:
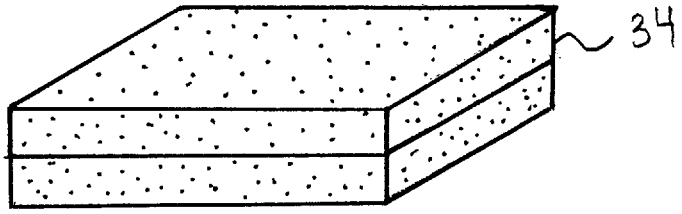
FIG. 8 is an illustration of a multiple playing piece resulting from a crowning of a player's piece when that player's piece has reached the opposite end of the board.
Figure 9:
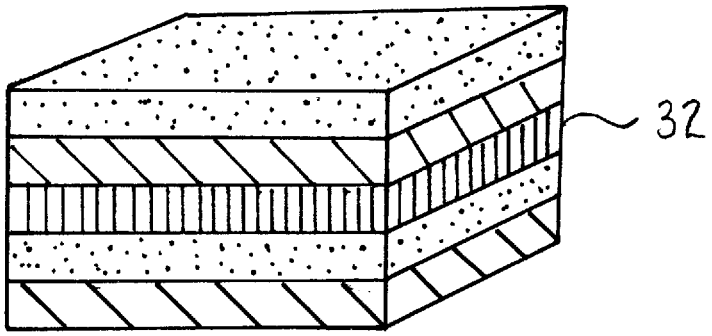
FIG. 9 is an illustration of a multiple playing piece resulting after a capture of an opponent's multiple piece.
Figure 11:
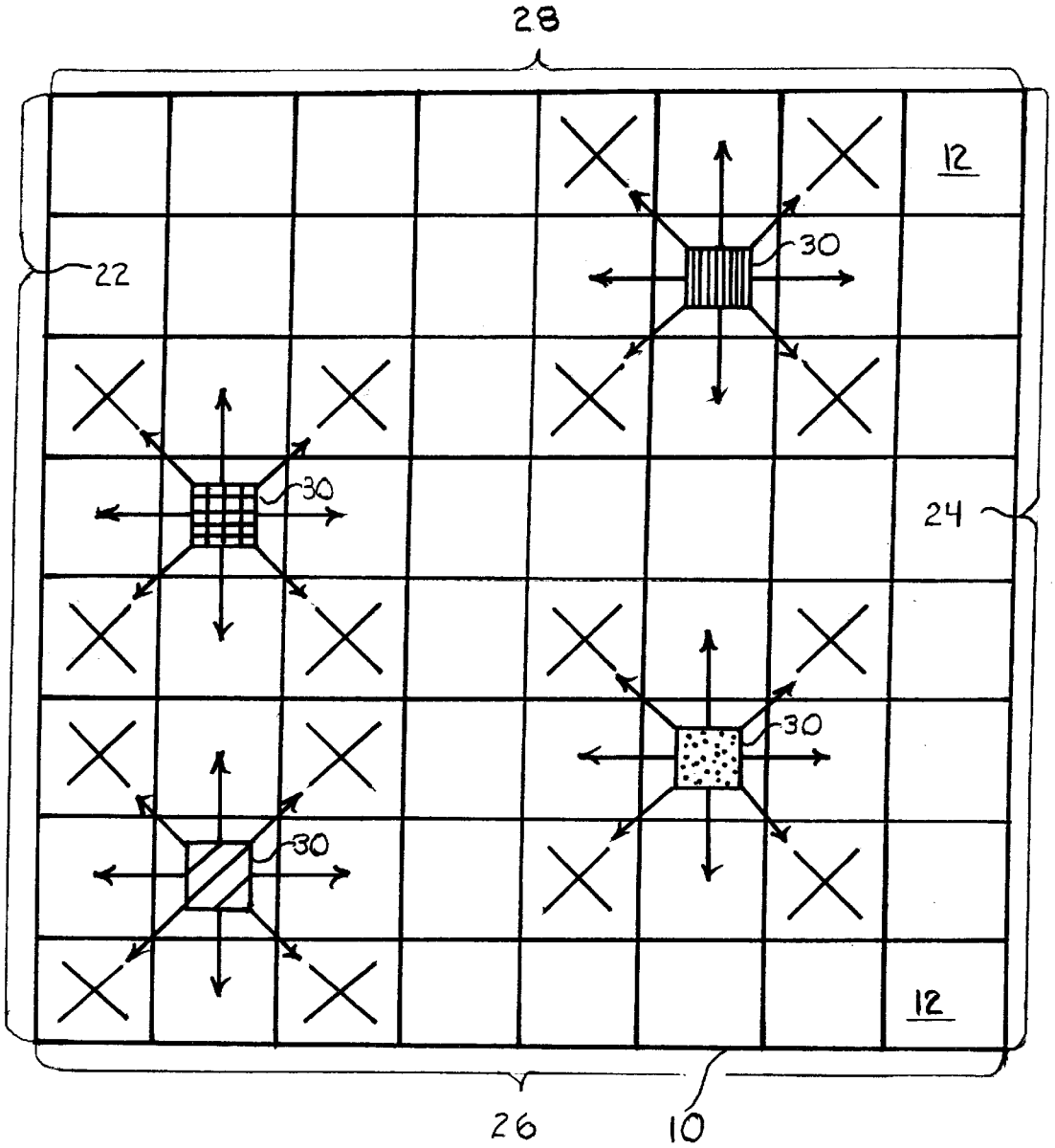
FIG. 11 is a plan view of selected multiple (stacked) playing pieces in which their direction and distance of movement is illustrated. Also

FIG. 11 illustrates the permissible and non-permissible moves of multiple (stacked) playing pieces 30 in FIG. 7 or piece 32 in FIG. 9 or piece 34 in FIG. 8 on board 10. Regardless of how many single pieces 20 are stacked, for instance, piece 30, 32 or 34, the resultant possible movements are the same: one square 12 forward, backward or sideways, never diagonal. This illustration assumes four players are playing but the movements are the same regardless of whether it is two, three of four players playing.

Figure 12:
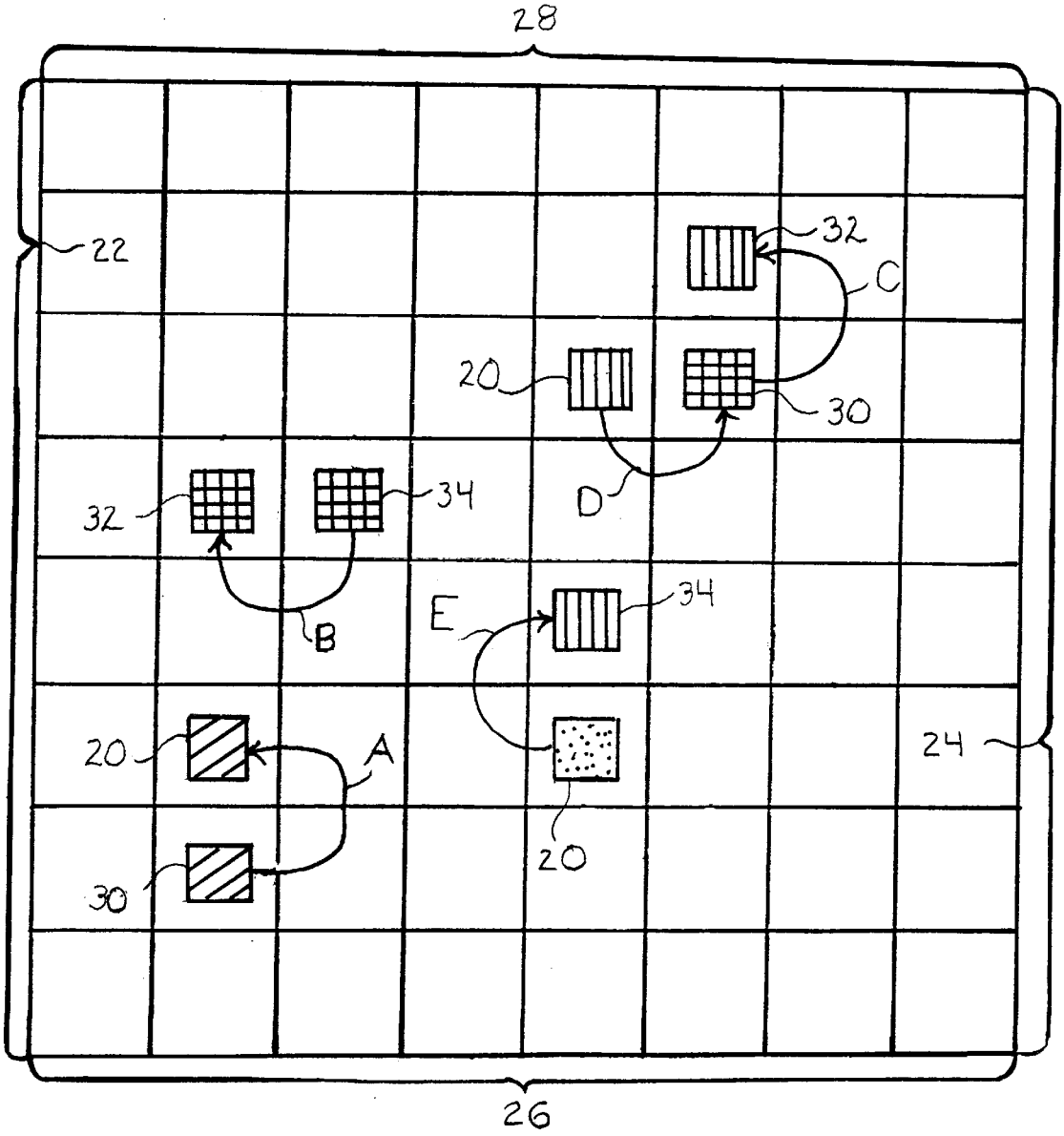
FIG. 12 is a plan view of selected various (stacked and unstacked) playing pieces in which certain particular moves are demonstrated and in which certain particular limitations are also depicted.

FIG. 12 illustrates various permissible and non-permissible moves on board 10 of both single (unstacked) pieces 20 and multiple (stacked) pieces 30, 32 and 34 in relation to other various selected pieces: Movement A of multiple stacked piece 30 onto single unstacked piece 20 is not permissible as they are pieces of the same color or shading. Movement B of multiple stacked piece 34 backward onto multiple stacked piece 32 is not permissible, as again they are pieces of the same color or shading. Pieces (20, 30, 32 or 34) of the same color or shading can never move onto or stack upon another piece (20, 30, 32 or 34) of the same color or shading. Movement C of multiple stacked piece 30 onto multiple stacked piece 32 is permissible as they are not of the same shade or color. Also this movement C demonstrates that a multiple stacked piece 30 can stack upon another multiple stacked piece 32 even if that piece 30 consists of less stacked pieces 20 than the piece 32 that it is capturing or stacking upon. This move is also mandatory in that a multiple piece (30, 32 or 34) must capture or stack upon another piece (20, 30, 32 or 34) if the opposing piece is one square 12 in front of or one square 12 beside, or one square 12 behind the multiple piece and it is that player's turn. If a player has the opportunity to capture two or more of opposing player's pieces (20, 30, 32 or 34) the attacking player may choose which piece (20, 30, 32 or 34) to capture. As previously mentioned players take turns one move per turn clockwise. Movement D of single unstacked piece 20 backward onto multiple stacked piece 30 is not permissible, as a single unstacked piece 20 can never move backward. This is a backward movement for piece 20 because that particular player's pieces 20 were set up at the beginning of the game in home range 24. Movement E of single unstacked piece 20 forward onto multiple stacked piece 34 is permissible and is mandatory if it is that player's turn. Also this movement E demonstrates that a single unstacked piece 20 can stack upon another multiple stacked piece (20, 32 or 34) even though it is only a single piece 20. This move is also mandatory in that a single piece 20 must capture or stack upon another piece (20, 30, 32 or 34) if the opposing piece is one square 12 in front of or one square 12 beside the single piece 20 and it is that player's turn.

Figure 13:
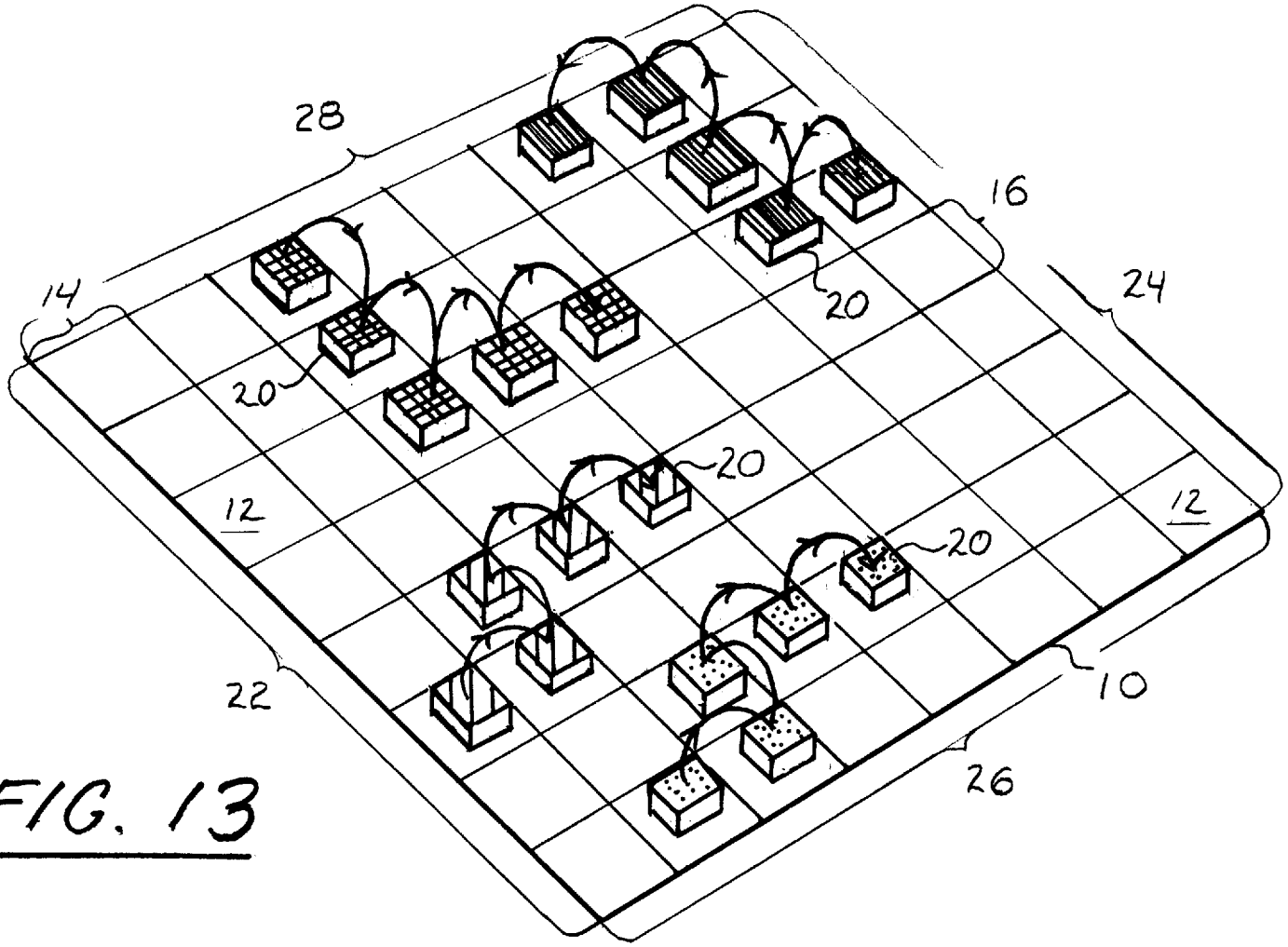
FIG. 13 illustrates sample moves of selected single (non-stacked) pieces.

FIG. 13 illustrates sample possible movements of single unstacked pieces 20 on board 10. As discussed each piece 20 can only move one square 12 per turn and only in a forward or sideways direction as determined by that player's original home region 22, 24, 26 or 28. Players take turns clockwise.

Figure 14:
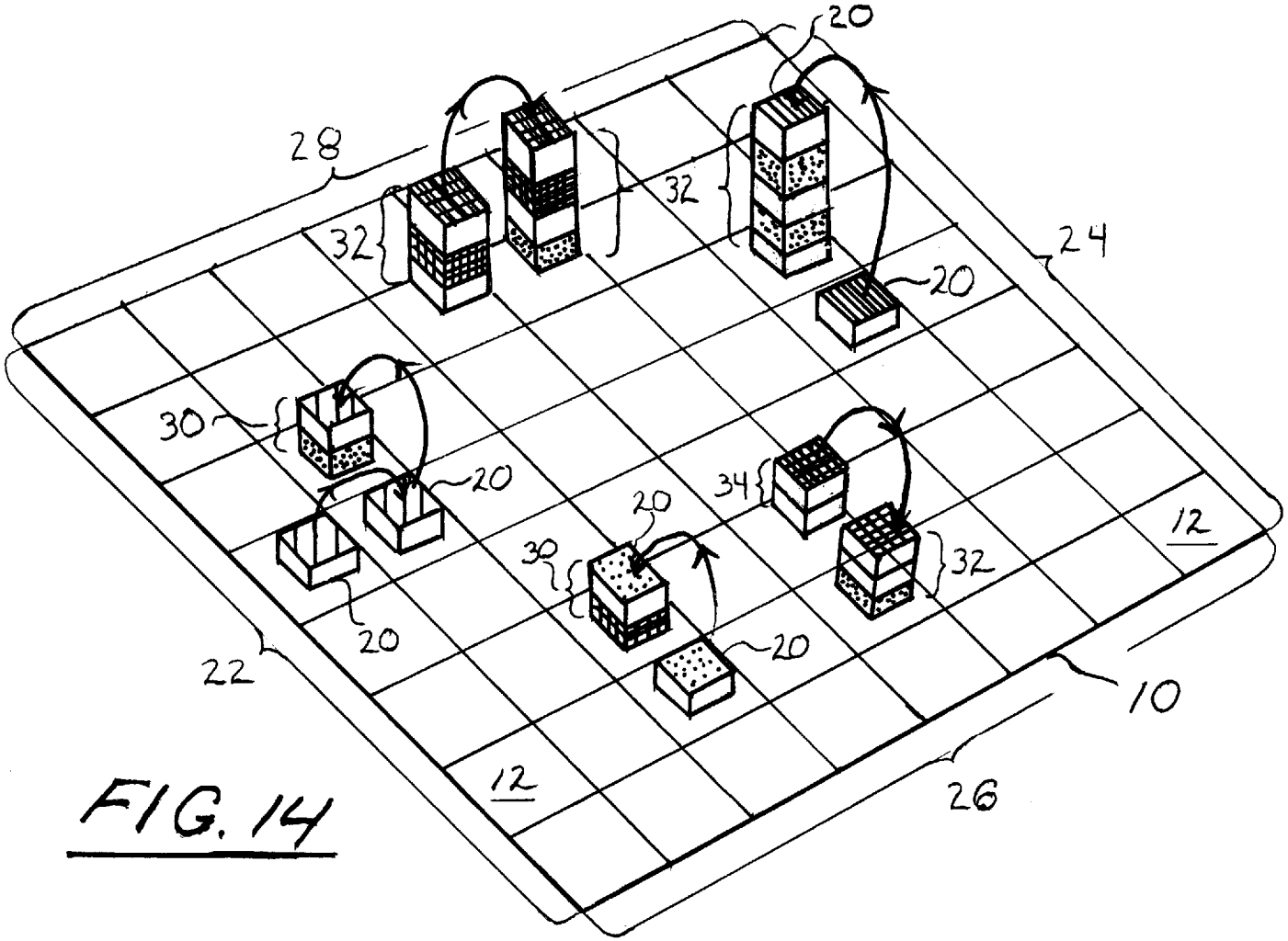
FIG. 14 illustrates sample capturing movements of single (unstacked) and multiple (stacked) pieces.

FIG. 14 illustrates sample possible capturing movements of pieces 20, 30, 32 and 34 on board 10. In capturing, a player places his attacking piece (20, 30, 32 or 34) atop the captured piece (20, 30, 32 or 34). The new stacked piece then becomes the piece of the attacking player. These pieces can never again become unstacked.

Figure 15:
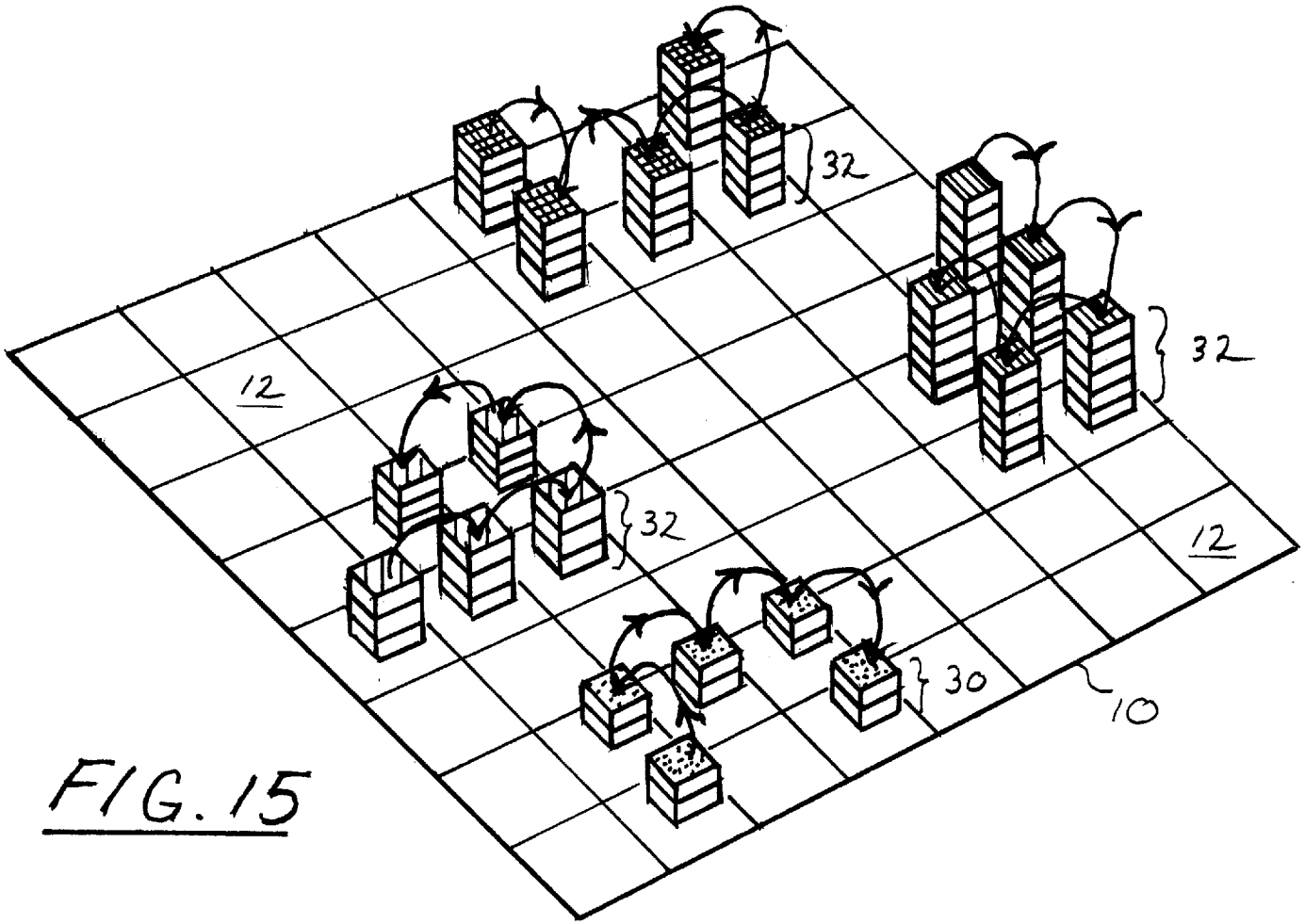
FIG. 15 illustrates sample moves of selected multiple (stacked) pieces.

FIG. 15 illustrates sample possible movements of multiple stacked pieces (30, 32 or 34) on board 10. As previously mentioned each player can only move one square 12 per turn clockwise. Multiple stacked pieces (30, 32 or 34) can move one square 12 forward, backward or sideways at a time.

Figure 16:
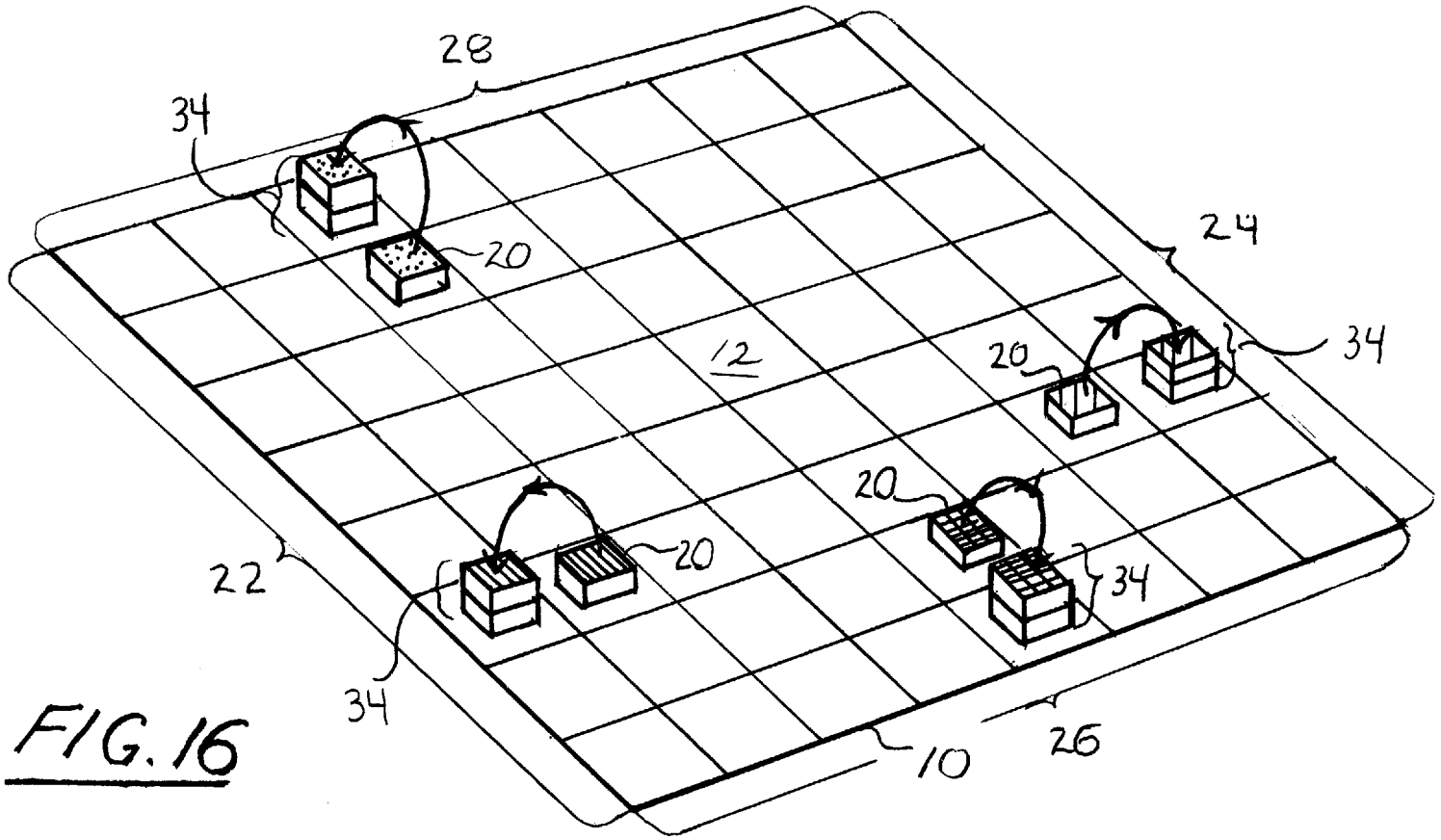
FIG. 16 illustrates movements of single (unstacked) pieces, which reach the opposite end of the board from which they started and therefore are crowned.

FIG. 16 illustrates sample-crowning movements of single unstacked pieces 20. A single unstacked piece 20 must reach the opposite end of the board 10 from that player's home region (22, 24, 26 or 28). The single piece 20 when it reaches the opposite end of the board 10 is crowned with an additional extra single piece 20 of the same shade or color to become the new piece 34. This piece 34 then moves and captures like all other multiple stacked pieces (30 and 34) as previously described.

As many different and varied embodiments may be made within the range of this invention, it is to be understood that the details herein described are to be interpreted as illustrative and not in a limiting way.

Having thus described the invention, I claim the following:

1. A board game for two, three or four players comprising:

(a) a flat, square game board consisting of 64 alternating squares of contrasting colors;

(b) four sets of nine playing pieces of which each set is colored or shaded to distinguish those of one player from the set of another player;

(c) nine homogenous playing pieces setup in the shape of a pyramid along the perimeter or home region of said game board with the possibility of a two, three or four player setup;

(d) said playing pieces being movable, in turn, one space forward or in a sideways direction on said game board;

(d) said playing pieces of one color or shading capturing an opponent's piece of a different color or shading by moving one space forward or sideways on top of the opponent's piece with resultant stacked playing piece now being able to move one space forward, sideways and also backward;

(e) the requirement that one piece on its turn must capture an opponent's piece if an opportunity to capture exists;

(e) said playing piece reaching the opposite end of the home region and thus being crowned with an additional single piece of the same color or shading with resultant stacked playing piece now being able to move one space forward, sideways as well as backward;

(f) where the game is won when one set of pieces captures all opponent's pieces and is the last remaining piece standing.

2. A method of playing a board game which consists of the steps of:

(a) constructing and arranging a flat, square game board with a grid of alternating square spaces which form adjacent rows and columns of equal size; the squares being of contrasting colors;

(b) coloring or shading of four sets of nine playing pieces so as to distinguish those of one player from those of another player;

(c) a setup of two, three or four players in the shape of a pyramid along the perimeter or home regions of the gameboard;

(d) moving a said playing piece, in turn, on said game board one space forward or sideways;

(e) the method of capturing an opposing piece by moving one space forward or sideways on top of the opponent's piece the resulting piece then having the ability to move one space forward, sideways and also backward;

(f) the requirement that upon a player's turn the player must capture an opponent's piece if an opportunity to capture exists;

(g) the method of crowning a single piece that has reached the opposite end of the said game board resulting in a stacked piece, which can then move one square forward, sideways and also backward;

(h) winning the game by being the first player to capture all other opponent's pieces thus being the last piece standing.

* * * * *